United States Patent [19]

Sasaki

[11] 3,991,676

[45] Nov. 16, 1976

[54] HIGH SPEED PRINTER WITH MULTICOLOR INK RIBBON

[75] Inventor: Rentaro Sasaki, Takasaki, Japan

[73] Assignee: Oki Electric Industry Co., Ltd., Tokyo, Japan

[22] Filed: Mar. 6, 1975

[21] Appl. No.: 555,849

Related U.S. Application Data

[63] Continuation of Ser. No. 360,123, May 14, 1973, abandoned.

[52] U.S. Cl. ..... 101/102; 197/172; 101/107; 101/336

[51] Int. Cl.[2] ..... B41F 31/16

[58] Field of Search ..... 101/96, 102, 107, 111, 101/336; 197/20, 2, 151, 157, 159, 172

[56] References Cited

UNITED STATES PATENTS

| | | | |
|---|---|---|---|
| 2,734,455 | 2/1956 | Phinney | 101/336 |
| 2,830,689 | 4/1958 | Clancy et al. | 197/172 |
| 3,461,998 | 8/1969 | Ploeger | 197/172 |
| 3,552,310 | 1/1971 | Clary | 101/102 |
| 3,583,315 | 6/1971 | Hebert | 101/336 X |
| 3,754,504 | 8/1973 | Clary | 197/151 X |
| 3,797,387 | 3/1974 | Decker et al. | 101/93.09 |
| 3,844,210 | 10/1974 | Allais | 101/102 |
| 3,861,305 | 1/1975 | Sasaki | 101/336 |

FOREIGN PATENTS OR APPLICATIONS

| | | | |
|---|---|---|---|
| 1,238,935 | 4/1967 | Germany | 197/172 |

*Primary Examiner*—Edward M. Coven
*Attorney, Agent, or Firm*—Peter L. Berger

[57] ABSTRACT

A high speed multicolor printing apparatus having an ink ribbon with colored stripes or bands of different colors to allow printing of a certain line with a different color from the other lines. The apparatus is provided with means to control the selected color for printing.

8 Claims, 11 Drawing Figures

FIG. 1
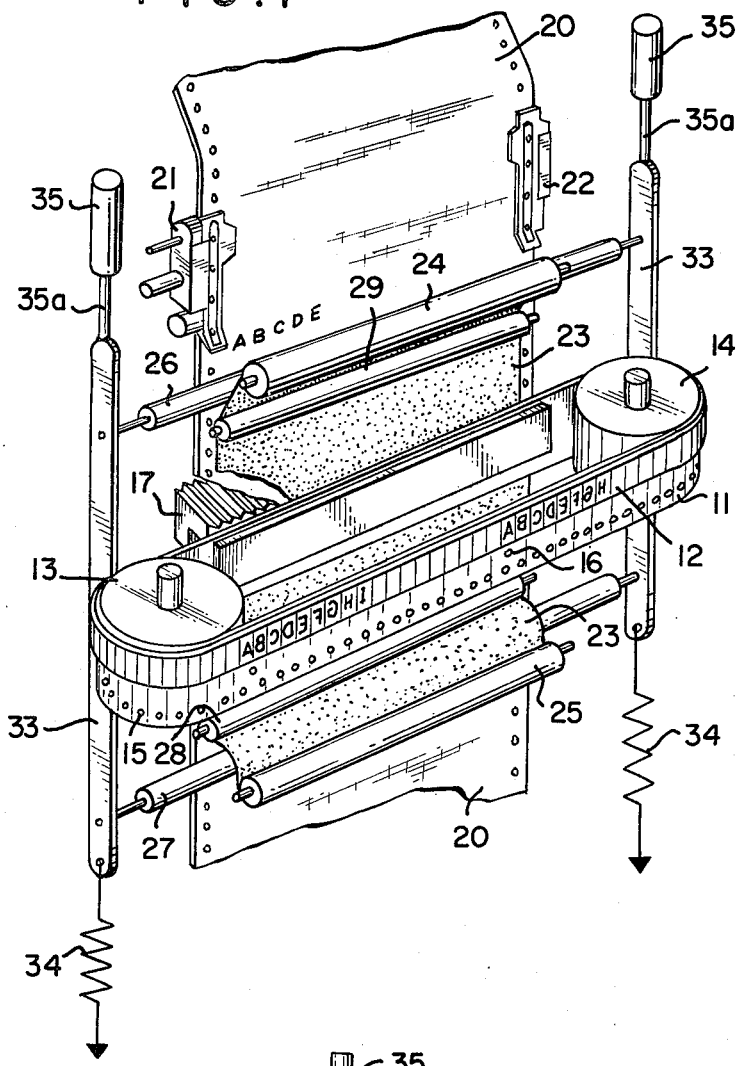
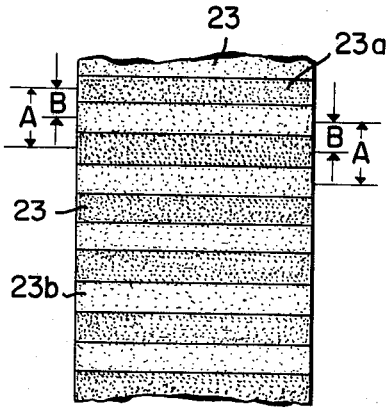
FIG. 3
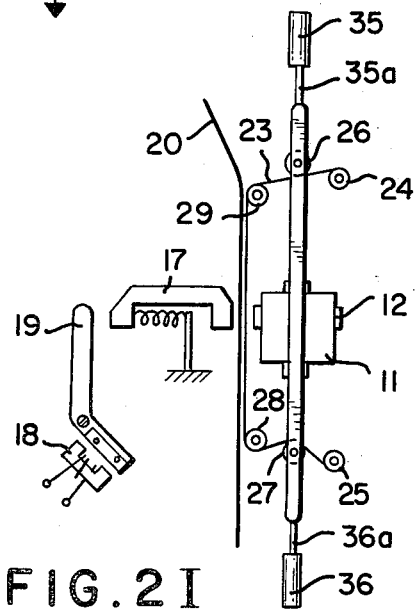
FIG. 2 I
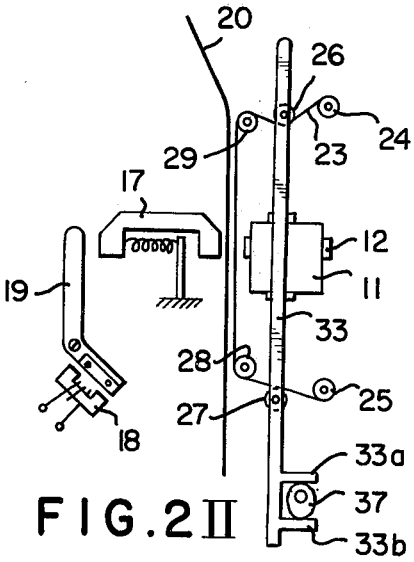
FIG. 2 II

HIGH SPEED PRINTER WITH MULTICOLOR INK RIBBON

This is a continuation in part application of Ser. No. 360,123 dated May 14, 1973 entitled: "MULTICOLOR INK RIBBON FOR HIGH SPEED PRINTERS," now abandoned.

OBJECTS OF THE INVENTION

A primary object of the present invention is to obtain control apparatus for a wide ink ribbon having on its surface colored stripes or bands of different colors from each other, the control apparatus allowing printing with a desired color by changing the ribbon feed pitch.

Another object of the present invention is to obtain such an ink ribbon having on its surface an ink-impermeable part disposed between each adjoining colored stripe so that, when the ribbon is on a reel, the inks in the stripes of different colors will not directly be contacting each other, thereby preventing the ink of one color from running into the ink of a different color.

Still another object of the present invention is to provide such an ink ribbon having on its one side an ink-impermeable film portion arranged such that even if the stripes of different colors overlapped each other when the ribbon is taken up on a reel, the portion will prevent the ink of one color from running into the ink of another color.

BRIEF DESCRIPTION OF THE DRAWING

FIG. 1 is a schematic perspective view of a high speed printing machine with the control means using an ink ribbon according to the present invention;

FIG. 2I and FIG. 2II are schematic side views showing alternative embodiments of the mechanisms for selecting desired colored stripes on the ink ribbon;

FIG. 3 is a plane view of an ink ribbon used with the present invention;

DETAILED DESCRIPTION OF THE INVENTION

Figure 4:
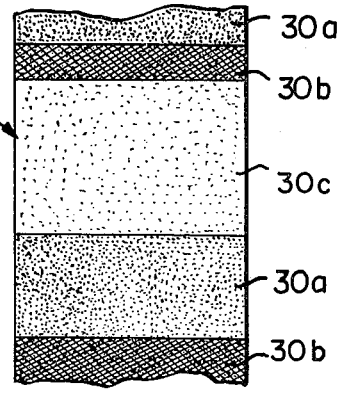
FIG. 4 is a plane view of another embodiment of an ink ribbon used with the present invention.

Referring first to FIG. 1, there is shown schematically in perspective a high speed printing machine using an ink ribbon and control means according to the present invention. In the figure, numeral 11 indicates a strip-shaped endless belt made of a thin steel plate or other like material, and a plurality of printing types 12 are detachably arranged on the belt 11 at equal intervals. The endless belt 11 is passed around a pair of drums 13 and 14 at both ends and is driven to move continuously by an electric motor not shown. The endless belt 11 is also formed with a line of scanning pulse apertures 15 located at the positions corresponding to the respective types 12 and pulse apertures 16 each of which is located at a position corresponding to the first type 12 of every group of types 12. The scanning pulse and pulse are sensed by a detection mechanism not shown. Numeral 17 denotes a number of printing hammers corresponding to the types 12 arranged on the endless belt 11. For instance, there may be as many hammers 17 as the width of a printing paper 20 permits, that is, in the same number as the maximum number of letters typed in one line on the printing paper 20. These printing hammers 17 are actuated to effect desired printing by the operation of an electromagnet 18 and an actuator 19 by conventional means (see FIGS. 2I and 2II). Printing paper sheet 20 is intermittently drawn out by a pair of pin tractors 21 and 22. Designated by numeral 23 is an ink ribbon according to an embodiment of the present invention. Said ink ribbon 23 has on its printing surface colored stripes or bands of different colors, such as for example black-colored bands 23*a* and red-colored bands 23*b*, arranged alternately as shown in FIG. 3 to permit printing with either of said colors. Said ink ribbon 23 is delivered from one reel 24 to another reel 25, or vice versa, portionwise at a pitch A (see FIG. 3) by a suitable driving mechanism. Numerals 26 and 27 indicate a pair of ink ribbon color selecting rollers, and 28 and 29 the guide rollers, respectively.

Numeral 33 is a lever with the ink ribbon color selecting rollers 26 and 27 coupled thereto. Though omitted in the drawing, the other ends of the rollers 26 and 27 are also linked by another lever. Numeral 34 indicates a spring connected to one end of the lever 33. Numeral 35 represents a plunger magnet, and its armature 35*a* is connected to the other end of the lever 33.

Thus, usually, lever 33 assumes the lower position due to the spring 34. Accordingly, since the ink ribbon color selecting roller 26 creases the upper part of the ribbon 23, the ribbon color is displaced to, for example, red at the printing position.

If the plunger magnet 35 is then energized, its armature 35*a* will carry the lever 33 to an upper position resisting to tensile force of the spring 34. By this action, the ink ribbon color selecting roller 27 creases the lower part of the ribbon 23, changing the pitch feed and this position causes ribbon color in printing position to be changed to black, for example.

The color selecting operation is described with particular reference to FIGS. 2I and 2II.

Shown in these figures are schematic side views of alternative embodiments of the ink ribbon color selecting mechanism, where FIG. 2I shows a situation in which the printing operation has been switched to for example the black color printing and FIG. 2II shows a situation where the printing pattern has been switched to the red color printing. In the situation of FIG. 2I, the switch-over mechanism including the ink ribbon color selecting rollers 26 and 27 is shifted to the upper position, so that only the black strips 23*a* on the ribbon 23 are allowed to pass the respective type positions, and hence black letters are printed on the printing paper 20. This is accomplished by a feed pitch control mechanism similar to that of FIG. 1, except that a second plunger magnet 36 and armature 36*a* is used for the lower force means instead of the spring 34.

When it is desired to switch to the red-colored printing situation for printing the letters in red to call particular attention to such letters or for other purposes, the pitch feed mechanism shifts position so that upper roller 26 bears against and creases the ribbon rather than the lower roller 27. The pitch feed mechanism including lever 33 and the selecting rollers 26 and 27 is shifted to the lower position as shown in FIG. 2, whereby the ink ribbon 23 is shifted by a distance B as shown in FIG. 3 and consequently the red stripes 23*b* now take the positions coinciding with the respective type positions, and as the ink ribbon 23 is delivered successively at a pitch A, the red stripes 23*b* on said ribbon 23 pass the respective type positions to thereby print letters in red.

Referring to FIG. 2II, there is shown still another embodiment of the control means in which a pair of protrusions 33*a* and 33*b* are provided at one end of the lever 33. An eccentric cam 37 is inscribingly fitted inside of these protrusions 33*a* and 33*b*. Therefore, when the eccentric cam 37 is rotated halfway, the lever 33 is selectively positioned to the upper or lower positions and the appropriate ribbon color at the printing position can be selected, which is red as indicated above.

Figure 5:
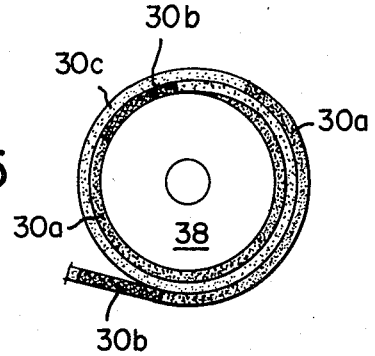
FIG. 5 is a side view showing a situation in which the ink ribbon of FIG. 4 is being wound up on a drum.

Referring now to FIG. 4, there is shown another embodiment of the ribbon of the present invention, comprising a wide ink ribbon 30 formed of a combination of black-ink bands 30*a*, red-ink bands 30*b* and ink-impermeable bands 30*c*, all of said bands 30*a*, 30*b* and 30*c* being arranged in regular order along the length of the ribbon 30. A line of printing types 12 is set laterally in the drawing and the ribbon 30 advances transversely to said line of types 12, as in the above description of FIG. 1. When this wide ink ribbon is wound up on reel 38, the respective colored bands 30*a* and 30*b* are separated from each other by the impermeable bands 30*c* as shown in FIG. 5, and the ink of one band 30*a* or 30*b* is blocked from penetrating into the ink of the other band.

Thus, use of the ink ribbon 30 according to this embodiment can prevent running of the ink of one color into the ink of different color, thereby always providing fresh color in each colored band 30*a* or 30*b*.

Figure 6:
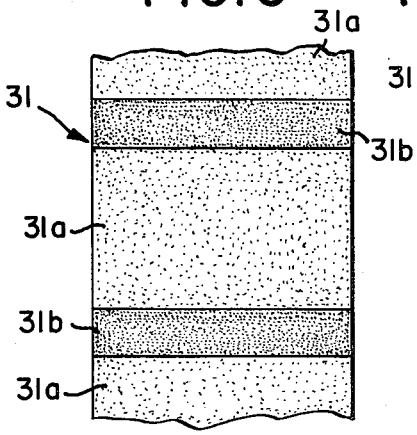
FIG. 6 is a plane view of still another form of ink ribbon used with the present invention.
Figure 7:
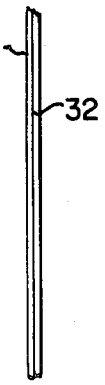
FIG. 7 is a sectional view of the ribbon shown in FIG. 6.

In FIGS. 6 and 7 there is shown an ink ribbon according to still another embodiment of the present invention. This ink ribbon consists of a two-color wide ribbon strip 31 formed from alternately arranged black-inked portions 31*a* and red-inked portions 31*b* and an ink-impermeable film 32 applied on the backside of said ribbon strip 31.

This ink ribbon may be produced for instance by affixing an ink-impermeable film 32 to the backside of a ribbon strip 31 by heat sealing, by using an adhesive, or by crushing the ribbon meshes to fill the interstices on one side of the fabric by for instance heating only one side of the ribbon strip 31 to turn said side into an ink-impermeable film-like structure. It is also possible to apply a water resisting agent on one side of said ribbon strip to make said side impermeable to ink.

Above are embodiments where an ink ribbon strip 31 is used, but it is possible to directly apply inks of different colors to the impermeable film 32.

The ribbon is used while it is successively moved and wound up in a direction transverse to the two-color stripes. Therefore, when the ribbon is wound up on a reel, the ribbon portions of different colors contact each other, and if such ribbon is made of an ordinary woven fabric, the different color inks may penetrate into each other to cause mixing of colors to spoil the quality of the prints. In this invention, however, since an ink-impermeable film 32 is provided on one side of the ribbon, the different color inks, such as black and red, are prevented from running into each other, allowing obtaining of always fresh and clear colored prints.

What is claimed is:

1. For a high speed multicolor printer printing lines which extend in a horizontal direction, the invention comprising a continuous ink ribbon vertically movable with respect to said printer and having a width substantially equal to the width of said print lines, said continuous ink ribbon comprising a plurality of adjoining horizontal ink bands having different colors, said different colored ink bands extending horizontally across the width of said ink ribbon, and control means to vertically move said ink ribbon a selected amount to move a selected one of said adjoining different colored ink bands to a printing position whereby a printing line can be printed in a selected one of said different colors.

2. The high speed multicolor printer as set forth in claim 1, further comprising upper and lower spaced apart guide rollers located above and below the line to be printed for guiding said ribbon past said printing mechanism for printing, said ink ribbon being maintained taut between said guide rollers, a supply reel for supplying said ink ribbon and a take-up reel for taking up said ink ribbon, upper and lower spaced apart ink ribbon selecting rollers with a respective one of said ink ribbon selecting rollers located between respective upper and lower of said guide rollers, and respective reels, means to move said upper and lower ink ribbon selecting rollers to selectively bear against the ink ribbon for shifting the ribbon upwardly or downwardly, respectively, to position a selected ink color band for printing.

3. The high speed multicolor printer according to claim 1, wherein said ink ribbon is wound on and supplied from a supply wheel, said ink ribbon comprising an ink impermeable band separating groups of adjoining horizontal ink bands, said ink impermeable band having a length greater than the total length of the adjoining bands such that when said ink ribbon is wound on said reel, said colored bands do not directly touch each other.

4. The high speed multicolor printer according to claim 1 wherein said ink ribbon is wound onto a reel, said ink ribbon comprising an impermeable film portion provided on one side of the ribbon such that when said ribbon is wound up on said reel, the inks of different colors in the respective bands will not permeate into and with each other.

5. The high speed multicolor printer as set forth in claim 4, wherein inks of different colors are directly applied to the impermeable film portion to form said bands.

6. The high speed multicolor printer as set forth in claim 1, wherein said ink ribbon comprises an ink-impermeable film pasted to one side of the ribbon.

7. The high speed multicolor printer as set forth in claim 1, wherein said ribbon comprises two colors alternately arranged on said ribbon.

8. The high speed multicolor printer as set forth in claim 7, wherein said two colors are red and black.

* * * * *